US005291692A

United States Patent [19]

Takahashi et al.

[11] Patent Number: 5,291,692

[45] Date of Patent: Mar. 8, 1994

[54] POLISHING WORK HOLDER

[75] Inventors: Mitsuaki Takahashi; Takayuki Kishida; Masaki Watanabe, all of Hachiooji; Kazuo Ushiyama, Akishima, all of Japan

[73] Assignee: Olympus Optical Company Limited, Japan

[21] Appl. No.: 583,173

[22] Filed: Sep. 10, 1990

[30] Foreign Application Priority Data

Sep. 14, 1989 [JP] Japan ..... 1-239500
Sep. 29, 1989 [JP] Japan ..... 1-254729
Oct. 3, 1989 [JP] Japan ..... 1-258276

[51] Int. Cl.[5] ..... B24B 47/00
[52] U.S. Cl. ..... 51/235; 51/216 LP
[58] Field of Search ..... 51/235, 216 R, 216 LP

[56] References Cited

U.S. PATENT DOCUMENTS 3,886,696 6/1975 Bruck ..... 51/216 LP
3,978,620 9/1976 Feneberg et al. ..... 51/216 LP
4,313,284 2/1982 Walsh ..... 51/235

FOREIGN PATENT DOCUMENTS 176854 10/1961 Sweden ..... 51/235

*Primary Examiner*—M. Rachuba
*Attorney, Agent, or Firm*—Bruce L. Adams; Van C. Wilks

[57] ABSTRACT

A polishing work holder for supporting a lens to be polished for use in a lens polishing machine is disclosed. The work holder comprises a holder body rotatably supported by a housing and having a recess portion formed on a rotating shaft of one end face thereof and a suction hole opened at the end face, a lens receptacle having a hole communicated with the suction hole to suck and hold a lens at one end surface, a spherical body intervened between the recess portion of the holder body and the lens holder so as to contact the another end face and for carrying the lens receptacle tiltably and movably in the crossing direction to the axis of the holder body, a fitting ring secured to the holder body concentrically and loosely fitted onto an outer periphery face of the lens or an outer periphery face of the lens receptacle so as to limit the tilting of the lens and the moving in the diametrical direction, and a sealing member provided between the holder body and the receptacle at outside of the suction hole.

16 Claims, 10 Drawing Sheets

POLISHING WORK HOLDER

BACKGROUND OF THE INVENTION

The present invention relates to a polishing work holder for supporting a lens to be polished for use in a lens polishing machine.

Such a polishing work holder is disclosed in Japanese Patent Application Laid-open No. 121 862/86 and Japanese Utility Model Application Publication No. 37,627/87.

The former is shown in FIG. 17, in which a polishing dish 60 is rotated and swung, a polishing holder 63 is rotatably supported by a housing 61 through a bearing 62 and is fixed vertically relative to the direction of a sphere center of the polishing dish 60 and a pressure is added thereto in order to polish a lens 64. A spring 65 is attached to a tip portion of the polishing holder 63, thereby elastically pressing the lens 64 between the polishing dish 60 and the polishing holder 63.

The latter is shown in FIG. 18, in which a lens holding device for use in a lens polishing machine include a lens drive lever 67 capable of moving in the horizontal direction while continuously urging in a vertical direction surface of a polishing dish 66 which is rotatably supported about its axis. The lens holding device comprises an inversed cup body 68 rotatably attached at a tip portion of the lens drive lever 67, and a lens receptacle 70 detachably fitted in the inversed cup body 68. The inversed cup body 68 contacts the lens receptacle 70 through an elastic ring 69 so as to tilt by an infinitesimal angle relative to the inversed cup body 68, a recess portion 72 formed at lower surface of the lens receptacle 70. The lens receptacle 70 holds a lens 71 therein, and communicating holes 73, 74 formed in the lens receptacle 70 and supporting shaft of the cup body 68 adhere the lens 71 to the lens receptacle 70 under vacuum suction.

The teachings of (Japanese Patent Application Laid-open No. 121,862/86, however do not provide a mechanism for limiting movement of lens 64 in the radial direction, so that when polishing with fixed abrasive grain wheel or the like, the lens 64 is pulled by polishing resistance in the radial direction and thus the axis of lens becomes excessively shifted.

The (Japanese Utility Model Application Publication No. 37,627/87) teaches that, the lens receptacle 70 limits movement of the lens 71 in the radial direction, and is adhered to the inversed cup body 68 under vacuum suction through the elastic member 69 of rubber or the like, so that as in the former, the entire lens receptacle is pulled in the radial direction because of polishing resistance during the polishing process, and thus the axis of lens becomes shifted. When polishing occurs under such conditions, the movement of lens, that is, the movement of lens receptacle in the horizontal direction and infinitesimal displacement of lens receptacle in the vertical direction can not be adsorbed since the elastic member 69 is in the compressed state between the inversed cup body 68 and the lens receptacle 70. This results in chattering of the lens during polishing and thus machining becomes impossible and the accuracy of the machined surface degraded resulting in the production of many substandard articles.

SUMMARY OF THE INVENTION

It is an object of the present invention to overcome the above described disadvantages of the conventional polishing work holder.

It is another object of the present invention to provide a polishing work holder in which chattering of a lens is eliminated during polishing and a lens with excellent machining surface accuracy and high quality may be obtained.

According to the present invention, there is provided a polishing work holder which a holder body rotatably supported by a housing and having a recess portion formed on a rotating shaft of one end face thereof and a suction hole opened at the end face. A lens receptacle having a hole is provided communicated with the suction hole to hold a lens at one end surface, through suction, spherical body is disposed between the recess portion of the holder body and the lens holder so as to contact the another end face for supporting the lens receptacle tiltably and movably in the crossing direction relative to the axis of the holder body. A fitting ring secured to the holder body concentrically and is loosely fitted onto an outer periphery face of the lens or an outer periphery face of the lens receptacle so as to limit the tilting of the lens and to limit the movement of the lens in the diametrical direction. A sealing member provided between the holder body and the receptacle and is disposed outside of the suction hole.

A polishing work holder may include the inventive lens receptacle for carrying a lens, a holder body for supporting the lens receptacle, a spherical body intervened between the lens receptacle and the holder body a fixing ring provided on the same axis as that of the holder body for limiting the tilt and radial movement of the lens, and an elastic member provided between the lens receptacle and the holder body.

The inventive polishing work holder may include a holder body rotatably supported by a housing and having a recess portion formed on a rotating shaft of one end face thereof and a suction hole opened at the end face, a lens receptacle having a hole in communication with the suction hole for holding lens at one end surface through suction, a spherical body disposed between the recess portion of the holder body and the lens holder so as to contact the another end face and for supporting the lends receptacle tiltably and movably in the crossing direction relative to the axis of the holder body, a fitting ring secured to the holder body concentrically and loosely fitted onto an outer periphery face of the lens or an outer periphery face of the lens receptacle so as to limit the tilting of the lens and limit the movement of the lens in the diametrical direction, and an elastic member intervened between the holder body and the lens receptacle.

According to the polishing work holder of the present invention, the shifting of the lens (lens to be polished) in the radial direction may be limited to the range of the loose fitting, that is, the necessary and minimum of range, by the fixed ring, and the displacement (tilting) of lens and the displacement due to infinitesimal vibration caused by the rotating may be effectively absorbed within the above range.

According to the polishing work holder of a second embodiment of the present invention, when the lens is polished by adhering and supporting it by the polishing work holder, the rolling of the spherical body, which is point-contacted at the recess portion of the holder body, and the recess portion of the lens receptacle makes the movement of the lens receptacle adhere and supports the lens in the radial smooth the shifting of lens from its axis due to the polishing resistance may be effectively absorbed. The tilting of the lens receptacle about the spherical body absorbs the tilting of lens due to polishing resistance and infinitesimal vibrating displacement due to rotating with excellent followability, so that chattering of the lens does not occur during machining.

In accordance with the inventive polishing work holder the spherical body arranged between the holder body and the lens receptacle comes into point contact with the recess formed on the shaft center of the lens receptacle, so that the outer periphery of lens surface to be polished is close to the sphere center of the spherical body thereby forming a small contact angle during polishing and performing stable polishing.

The spherical body is also brought into point contact in the recess portion of the holder body or in the recess portion of the lens receptacle at its bottom surface, and the elastic O ring is fitted onto the spherical body, so that the axis of the holder body may easily be coincident with the axis of the lens receptacle.

According to the polishing work holder of a third embodiment of the present invention, the elasticity of the elastic member disposed between the holder body and the lens receptacle prevents the lens receptacle from being tilted abruptly, resulting in a desired action of the spherical body.

DETAILED EXPLANATION OF THE PREFERRED EMBODIMENT

Figure 1:
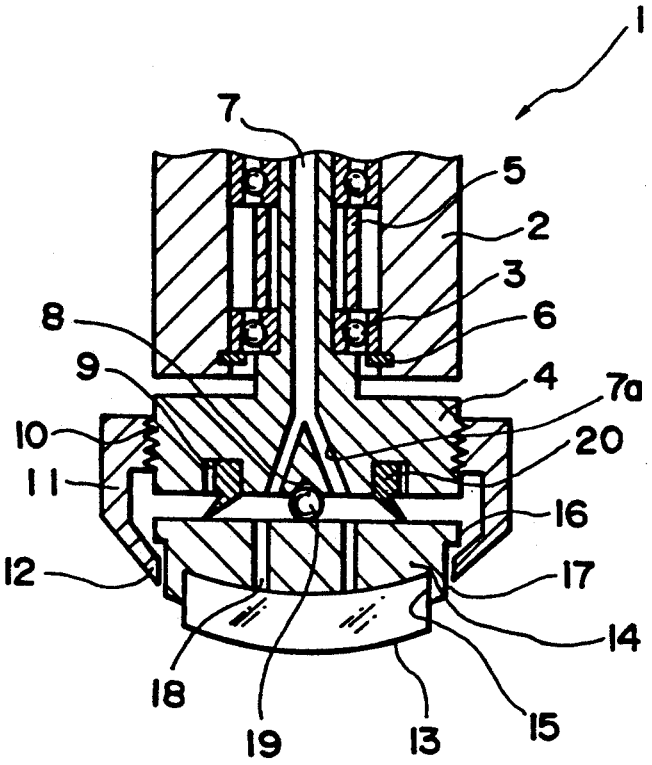
FIG. 1 is a longitudinal sectional view showing a first embodiment of a work holder according to the present invention.

Now to the drawings, there are shown various embodiments of a polishing work holder according to the present invention. Common elements are shown by corresponding reference characters throughout the several views of the drawings.

First Embodiment

FIG. 1 is a longitudinal sectional view showing a first embodiment of a polishing work holder 1 according to the present invention.

As shown in FIG. 1, a polishing work holder 1 has a holder body 4 which is rotatably supported by a housing 2 secured to a lens polishing machine (not shown) through a pair of upper and lower bearings 3. A collar 5 is disposed between a pair of bearings 3 which are supported in the housing 2 by an O ring 6. A communicating hole 7 communicated with a suction pump (not shown) is formed in a main center shaft portion of the holder body 4. The communicating hole 7 branches in four directions and into four branch holes 7*a* at a large diameter portion under the holder body 4.

The large diameter portion of the holder body 4 is provided with a conical recess portion 8 at its under shaft center portion and with a circular belt shaped recess 9 at outer side of the communicating hole 7. A screw 10 provided on the outer periphery surface of the large diameter portion of the holder body 4 is screwed in a screw provided inner side of a fixing ring 11. The diameter of inner center portion of the fixing ring 11 is larger than the inner diameter of lower end portion thereof.

The holder body 4 is provided with a lens receptacle 14 for supporting a lens 13 being polished. The lens receptacle 14 is engaged by the lower end portion 12 of the fixing ring 11. The lens receptacle 14 has an upper mirror-finished surface (in the drawing) and a lower surface which is provided with a recess portion 15 of the lens receptacle for fitting and holding the lens 13 therein (a recess having a receptacle surface corresponding to the radius of curvature of a lens surface being supported) as well as an outer periphery surface having step portions. A large diameter portion 16 of the step portion is engaged with the lower end portion 12 of the fixing ring 11 and a small diameter portion 17 of the step portion is loosely fitted in the lower end portion 12 of the fixing ring, thereby setting a proper gap; in this embodiment that is a range capable of inclining the lens 13 by an angle of 3.5° through the lens receptacle 14 to the shaft center of the holder body 4. The lens receptacle 14 is also provided with communicating holes 18 for communicating the upper surface with the lower surface thereof. A steel ball 19 for tiltably supporting the lens receptacle 14 to the holder body, is disposed between the upper surface of the lens receptacle 14 and the conical recess portion 8 of the holder body 4 and a sealing V ring 20 is arranged in the circular belt shaped recess 9 of the holder body.

When the lens 13 is adhered through suction by the lens receptacle 14 through the communicating hole 7 of the holder body 4, the large diameter portion 16 of the lens receptacle 14 is separated from the lower end portion 12 of the fixing ring 11 under negative pressure, so that the lens receptacle 14 becomes tiltable and movable in the orthogonal direction to the shaft center of the holder body 4.

When the lens 13 is polished with the use of the above constructed polishing work holder 1, the lens 13 being polished is mounted in the recess portion 15 of the lens receptacle 14 and adhered and held thereto through suction provided by the communicating hole 7 of the holder body 4 and the communicating hole 18 of the lens receptacle 14 under the drive of the suction pump (not shown).

In this case, as described above, the large diameter portion of the lens receptacle 14 is separated from the lower end portion 12 of the fixing ring 11, so that the lens receptacle 14 may be freely moved in the direction crossing relative to the shaft center of the holder body. Even through the large diameter portion of the lens receptacle 14 is engaged with the lower end portion 12 of the fixing ring 11, if the tip portion of the V ring 20 is formed by a flexible elastic member, the lens receptacle may also easily be moved in the direction crossing relative to the shaft center of the holder body. The lens 13 adhered and held by the polishing work holder 1 is depressed onto a polishing wheel (not shown) of the lens polishing machine arranged under the lens 13, thereby performing the polishing of the lens.

According to the above constructed work holder, even through the shift of the lens 13 in the radial direction arises during the polishing, the upper surface of the lens receptacle 14 for holding the lens has mirror finished surface, so that the whole lens receptacle 14 may smoothly moved in the radial direction by the steel ball 19 supported on the holder body 4.

In this case, the amount of movement of the lens receptacle in the radial direction is limited by the lower end portion 12 of the fixing ring 11 together with the limitation of the tilting angle of the lens receptacle.

Even if the displacement of the lens 13 arises due to the tilting and infinitesimal vibration within the above limited range, these displacements may be absorbed with excellent followability by the smooth relative sliding among the conical recess portion 8 of the holder body 4 and the upper surface of the lens receptacle 14 as well as the steel ball 19 disposed therebetween.

As a result of this, the chattering of the lens 13 during polishing is effectively prevented and thus a lens with an excellent machining accuracy surface and high quality may be obtained.

Second Embodiment

Figure 2:
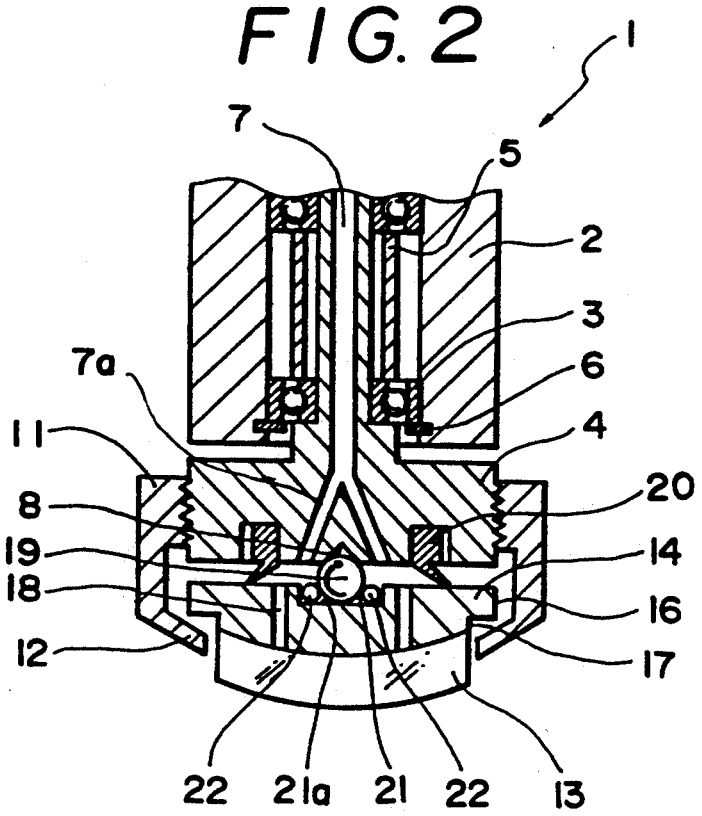
FIG. 2 is a longitudinal sectional view showing a second embodiment of a polishing work holder according to the present invention.

FIG. 2 is a longitudinal sectional view showing a second embodiment of polishing work holder according to the present invention. In this embodiment, the upper center portion of the lens receptacle 14 shown in FIG. 1 is provided with a recess portion 21 having the same inner diameter as, that of the lens receptacle 14, the small diameter portion 17 of the lens receptacle 14 at outer periphery portion thereof has the same diameter as the outer diameter of the lens 13, and an elastic I ring 22 is inserted in the recess portion 21 of the lens receptacle.

The steel ball 19 is inserted between the conical recess portion 8 formed at the lower end of the holder body 4 and the bottom surface 21*a* of the recess portion 21 of the lens receptacle 14 and the steel ball 19 is in contact with the O ring 22.

The rest of the work holder is the same as that of the work holder shown in FIG. 1, so that like parts are designated by the same reference numeral and explanation thereof is omitted.

The above construction of this embodiment may obtain the same advantageous effect as that of the first embodiment. According to the polishing work holder of the present embodiment, when no radial force is effected on the lens 13, the shaft center of the lens receptacle 14 may continuously be made coincident with the shaft center of the holder body 4.

When a radial force is applied to the lens 13, the movement of the lens receptacle may be absorbed by elastic deformation and the radial infinitesimal vibration of the lens 13 may also be absorbed to thus provide excellent followability.

Third Embodiment

Figure 3:
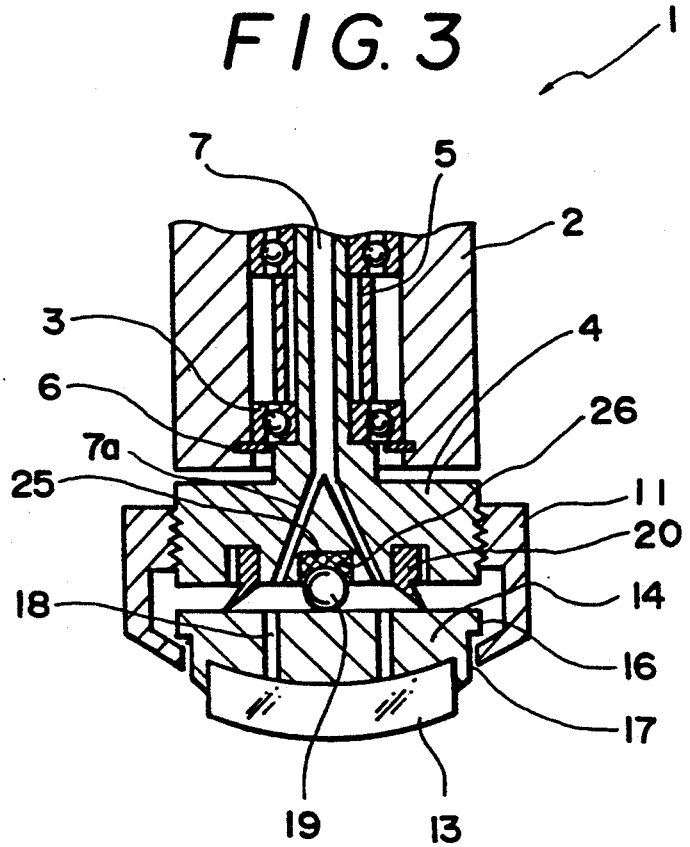
FIG. 3. is a longitudinal sectional view showing a third embodiment of a polishing work holder according to the present invention.

FIG. 3 is a longitudinal sectional view showing a third embodiment of the polishing work holder according to the present invention. In this embodiment, a receptacle portion for the steel ball 19 is inserted between the lens receptacle 14 and the holder body 4.

This is, the shaft center portion of the lower surface of the holder body 4 is provided with a recess portion 25 having the same diameter, and an elastic receptacle member 26 is secured in the recess portion 25. The upper surface of the lens receptacle 14 has a mirror finished surface.

In the above construction, also, the tilting and the displacement in the radial direction of the lens 13 may be absorbed with good followability, and in particular vibration absorption of the lens in the vertical direction may increase.

Fourth Embodiment

Figure 4:
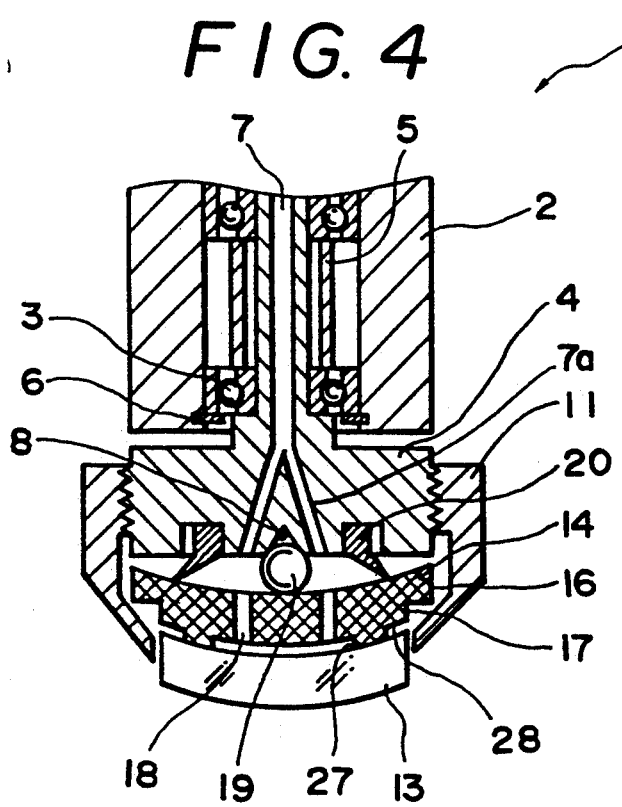
FIG. 4 is a longitudinal sectional view showing a fourth embodiment of a polishing work holder according to the present invention.

FIG. 4 is a sectional view showing a fourth embodiment of the inventive polishing work holder 1. In his embodiment, the lens receptacle 14 has of an elastic body. This lens receptacle 14 has an upper surface which is made a spherical recess surface and a lower surface which is provided with step portions 27 and 28 at its shaft center portion and a small diameter portion of outer periphery, respectively.

According to the above construction since the steel ball 19 is inserted in the conical recess portion 8 formed at the shaft center portion of the lower surface of the holder body 4, when no radial force is effected on the lens 13 the shaft center of the holder body 4 is always coincident with the shaft center of the lens receptacle 14, so that the position of the lens is easily determined and thus the lens 13 is easily detachable.

The lens 14 may also be securely adhered and held by the lower surface of the lens receptacle 14. Moreover, the displacement of infinitesimal vibration and the movement of the lens 13 in the vertical direction may also be absorbed with excellent followability.

Fifth Embodiment

Figure 5:
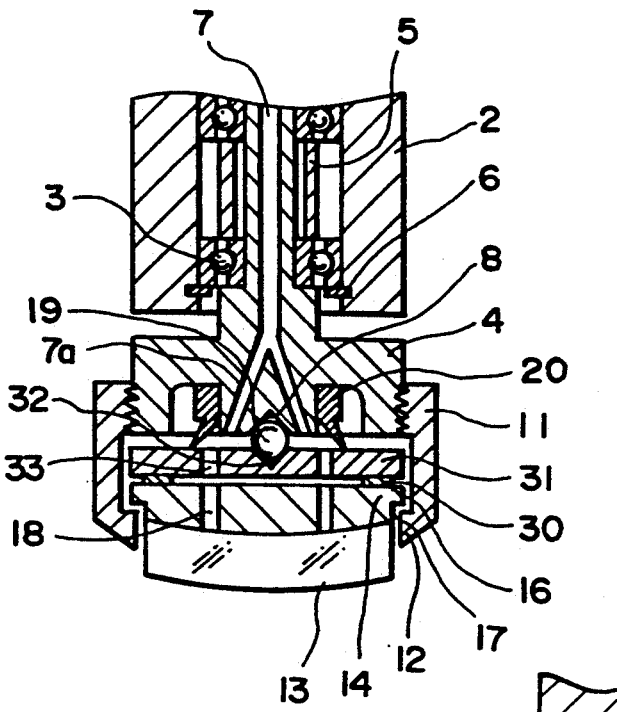
FIG. 5 is a longitudinal sectional view showing a fifth embodiment of a polishing work holder according to the present invention.

FIG. 5 is a sectional view showing a fifth embodiment of the inventive polishing work holder 1.

In this embodiment, a PTFE 30 as a member having a low friction factor and a steel ball receiving member 31 are disposed between the lens receptacle 14 and the holder body 4 shown in FIG. 1. The whole lens receptacle is constructed by a lens receptacle 14 and the PTFE 30 as well as the steel ball receiving member 31. The shaft center portion of the upper surface of the steel ball receiving member 31 is provided with a conical recess portion 32 for receiving the steel ball 19 therein and is provided with communicating holes 33 as in the communicating holes 18 of the lens receptacle 14. In this embodiment, also, as in the previous embodiment, the large diameter portion 16 of the lens receptacle 14 is separated from the lower end portion 12 of the fixing ring 11 so as to adhere after adsorbing and hold the lens 13 to the holder body 4.

According to the present embodiment, the displacement of the lens 13 in the radial direction may be absorbed with excellent followability, since the movement of the lens receptacle 14 to the shaft center of the holder body 4 is determined by the PTFE ring 30.

Sixth Embodiment

Figure 6:
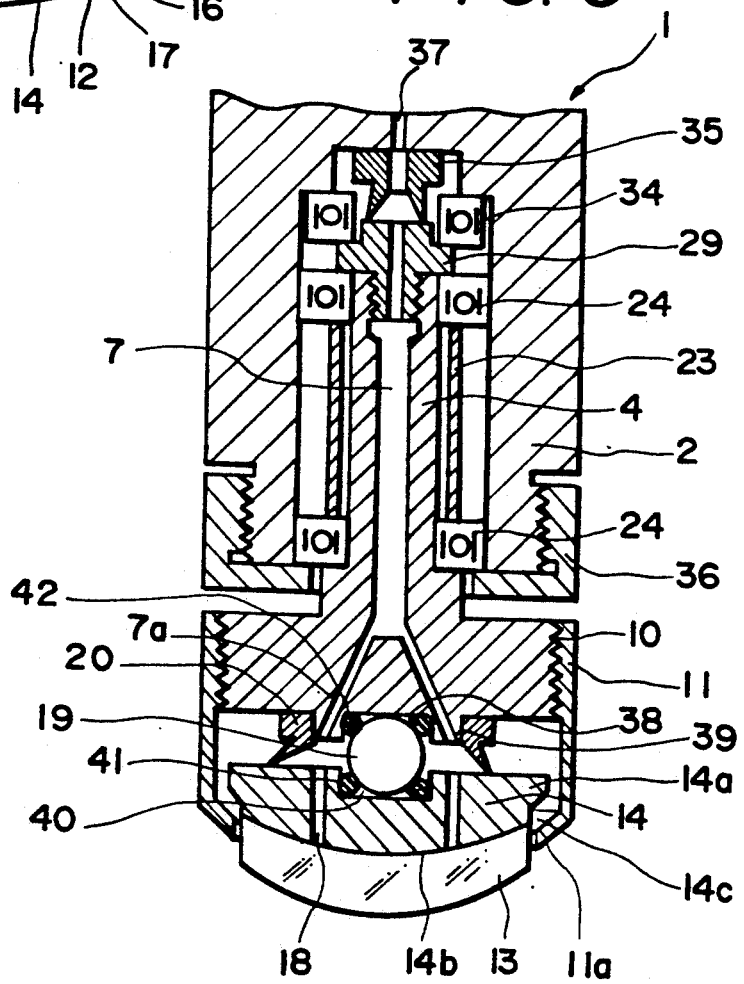
FIG. 6 is a longitudinal sectional view showing a sixth embodiment of a polishing work holder according to the present invention.

FIG. 6 is a sectional view showing a sixth embodiment of the inventive polishing work holder.

In this embodiment, the polishing work holder 1 includes a holder body 4 rotatably supported in a housing 2 which is attached to the lens polishing machine (not shown). A pair of vertically positioned radial bearing 24 is attached to the holder body 4 by fixing screw 29 through a collar 23 disposed around the body shaft portion. A thrust bearing 34 is held between the fixing screw 29 and a step portion formed in the housing 2. The holder body 4 is held to the housing 2 by screwing a clamp ring 36 so as to depress and fix a sealing V ring 35 to the inner side of the housing 2. The shaft center portion of the housing 2 is provided with a communicating hole 37 for communicating with a suction pump (not shown). The shaft center portions of the V ring 35 and the fixing screw 29 are provided with communicating holes, respectively, so as to communicate with a communicating hole 7 formed in the shaft center portion of the holder body 4. The communicating hole 7 branches in the four directions at the large diameter portion of the holder body 4 (lower end portion of the main shaft portion of holder body) and into branch holes 7*a* which are opened at lower surface of the large diameter portion of the holder body 4.

The shaft center portion at the lower surface of the large diameter portion of the holder body 4 is provided with a small diameter portion 39 having a concentric recess portion 38. A screw portion 10 formed at outer periphery of the large diameter portion of the holder body 4 is screwed into the screw portion formed at inner side of the fixing ring 11. The inner center portion of the fixing ring 11 has a diameter larger than the inner diameter of lower end portion 11*a* of the fixing ring 11.

A lens receptacle 14 for supporting a lens 13 to be polished thereto is disposed at the under side of the holder body 4. A flange portion 14*a* of the lens receptacle 14 is engaged with the lower end portion 11*a* of the fixing ring 11. This lens receptacle 14 has an upper flat surface and a lower surface which is provided with a lens receiving convex portion 14*b* (convex portion having receiving surface corresponding to radius of curvature of lens surface to be held) for adhering and holding the lens 13. The lens receptacle 14 also has an outer periphery surface having a step portion. The flange portion 14*a* of the step portion is engaged with the lower end portion 11*a* of the fixing ring 11 and a small diameter portion 14*c* of the step portion is loosely fitted in the lower end portion 11*a* of the fixing ring 11, thereby setting a suitable gap. Thus, in this embodiment, a range capable of limiting means, including the fixing ring 11, for limiting the tilting and movement of the lens to inclining the lens, 13 by an angle of 3.5° is provided to limit movement of the lens receptacle 14 relative to the shaft center of the holder body 4. In FIG. 6 the outer periphery engaged with the inner wall of the lower end portion of the fixing ring, but this outer periphery of the lens may be engaged with the small diameter portion of lens receptacle.

The lens receptacle 14 is provided at its upper surface with a recess portion 40 of the same diameter as that of the recess portion 38 disposed at an end surface of the holder body 5. The recess portion 40 is formed in the shaft center portion thereof corresponding to the shaft center of the holder body 4, and with a communicating hole 18 for communicating the upper surface of the lens receptacle 14 with the lower surface thereof.

A supporting member, such as a steel ball 19 or the like is arranged between the recess portion 40 of the lens receptacle 14 and the recess portion 38 of the holder body 4 so as to point-contact to the bottom surface of these recess portions and to tiltably support the lens receptacle 14 on the holder body 4. Elastic O rings 41, 42 each having hardness 60 are arranged in contact with to the steel ball 19 and the inner walls of respective recess portion 38, 40 and a sealing V ring 20 is arranged at outer side of the small diameter portion 39 of the holder body 4.

When the lens 13 is adhered through suction to the lens receptacle 14 through the communicating holes 37, 7 and 7*a* of the housing 2 and the holder body 4, the flange portion 14*a* of the lens receptacle 14 is separated from the lower end portion 11*a* of the fixing ring 11 under negative pressure, so that means are provided for positioning the lens receptacle 14 to be tiltable and movable in the radial direction relative (longitudinal direction) to the shaft center of the holder body 4.

When the lens 13 is polished with the use of the above constructed polishing work holder 1, the lens 13 being polished is mounted on the convex portion 14*b* of the lens receptacle 14 and adhered and held thereto through suction via the communicating hole 7 of the holder body 4 and the communicating hole 18 of the lens receptacle 14 under the drive of the section pump (not shown).

In this case, as described above, the flange portion 14*a* of the lens receptacle 14 is separated from the lower end portion 11*a* of the fixing ring 11 so that the lens receptacle 14 may be made tiltable and easily moved in the radial direction.

Then, the lens 13 adhered and held by the polishing work holder 1 is depressed onto a polishing wheel (not shown) of the lens polishing machine arranged under the lens 13, thereby performing the polishing of the lens.

According to the above constructed work holder, even if a shift of the lens 13 in the radial direction arises during the polishing the sliding between the bottom surfaces of respective recess portions of the holder body 4 and the lens receptacle 14 and the steel ball may move the whole lens receptacle 14 smoothly in the radial direction.

In this case, the amount of movement of the lens receptacle in the radial direction is limited by the lower end portion 11*a* of the fixing ring 11 together with the limitation of the tilting angle of the lens receptacle.

Even through the displacement of the lens 13 arises due to the tilting and infinitesimal vibration due to rotation within the above limited range, these displacements may be absorbed with excellent followability by the point contact among the recess portion 38 of the holder body 4 and the recess portion 40 of the lens receptacle 14 as well as the steel ball 19 disposed therebetween.

As a result of this, the chattering of the lens 13 during the polishing is effectively prevented and thus a lens with good machining surface accuracy and high quality may be obtained.

Even if the lens receptacle is tilted and moved in the radial direction to the holder body, the elasticity of the 0 ring arranged around the steel ball produces a restoring force, thereby compensating the shift of lens later generated.

After finishing the polishing of one lens, the shaft center of the lens receptacle is coincident with the shaft center of the holder body, so that the position of lens receiving a convex portion becomes constant, thereby performing stable lens mounting and stable lens removing.

Seventh Embodiment

Figure 7:
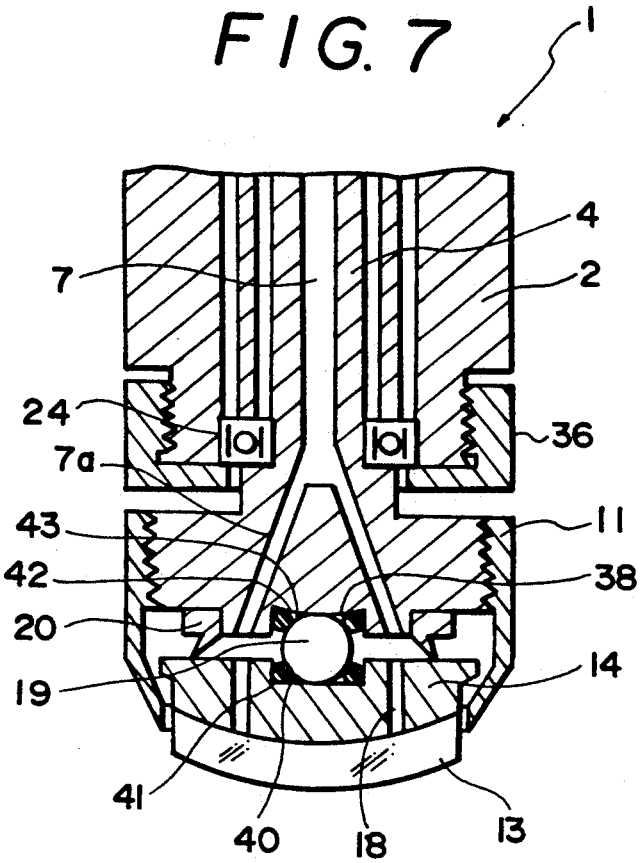
FIG. 7 is a longitudinal sectional view showing a seventh embodiment of a polishing work holder according to the present invention.

FIG. 7 is a longitudinal sectional view showing seventh embodiment of the polishing work holder according to the present invention. In this embodiment, the bottom surface of the recess portion 38 formed in the shaft center portion of holder body 4 shown in FIG. 6 is made a concentrical sphere surface 43 having the same center of curvature as that of the surface to be polished. A steel ball 19 is arranged between the bottom surface (flat) of the recess portion 40 of the lens receptacle 14 and the spherical surface 43 of the recess portion 38 of the holder body 4 and this steel ball 19 is made to contact with O rings 41 and 42.

The other construction of the work holder is the same as that of the work holder shown in FIG. 6, so that like elements are designated by the same reference numerals and explanation thereof is omitted.

In the above construction, the advantageous effect as in the sixth embodiment may also be obtained but according to the polishing work holder of the present embodiment the lens receptacle 14 may be tilted about the steel ball 19 and moved in the radial direction and along the surface to be polished of the lens 13. The convex spherical surface 43 of the recess portion 38 of the holder body 4 is made the contact the spherical surface of the steel ball 19, so that the displacement of the lens 13 during the polishing may be absorbed more effectively and thus the machining surface accuracy may further be increased.

In this embodiment, the bottom surface of the recess portion 38 of the holder body 7 is made to be a the concentric sphere surface relative to the surface of the lens to be polished, and the bottom surface of the recess portion 40 of the lens receptacle 14 is made flat. However, even if the bottom surface of recess portion 38 of the holder body 4 is made flat and the bottom surface of recess portion 40 of lens receptacle 14 is made to be the concentric sphere surface (concave sphere surface) relative to the surface to be polished of lens the same advantageous effect as that of the above may be obtained. In the case of the concave sphere, moreover, self-aligning action is obtained, so that the O ring 41 of the recess portion 40 may be removed.

If the bottom surface of the recess portion 38 of the holder body is made to be the convex spherical surface and the bottom surface of the recess portion 40 of the lens receptacle is made to be the concave spherical surface, the displacement of lens during the polishing may further be absorbed and thus the machining surface accuracy may also further be increased.

In the above embodiments, the surface to be polished of lens is convex surface, this surface to be polished may also be made concave surface.

Figure 8:
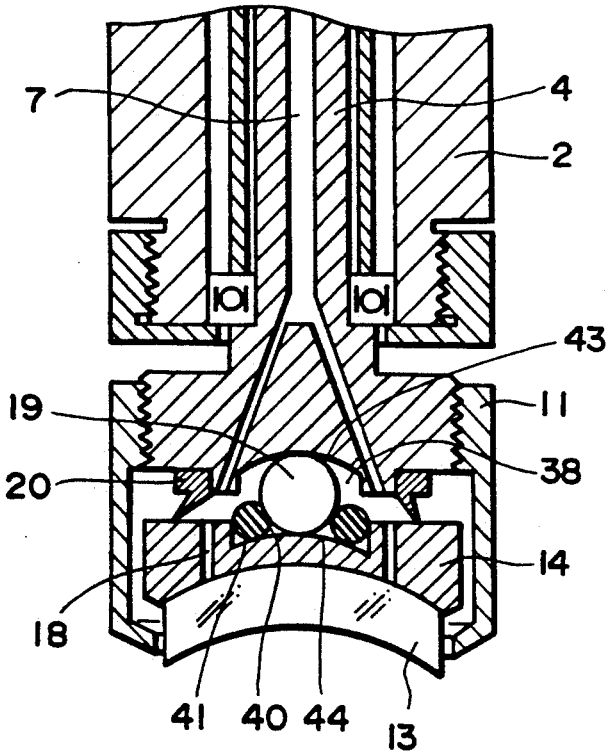
FIG. 8 and 9 are longitudinal sectional views showing other modifications of the seventh embodiment shown in FIG. 7.

As shown in FIG. 8, that is, the bottom surface of recess portion 38 of the holder body 4 and the bottom surface of recess portion 40 of lens receptacle 14 may be made the concentric sphere surface 43, 44 having the same center of curvature as that of the surface to be polished of the lens 13. In this case the tilting of the lens receptacle 14 is promoted by the point-contact to the steel ball 19 and the movement of the lens receptacle 14 along the surface to be machined is also promoted by the sliding of the steel ball 19 and respective recess portions 38, 40 and the rolling of the steel ball, so that the same effect as the above may be obtained.

In FIG. 8, the O ring in the recess portion 38 of the holder body 4 may be removed.

Figure 9:
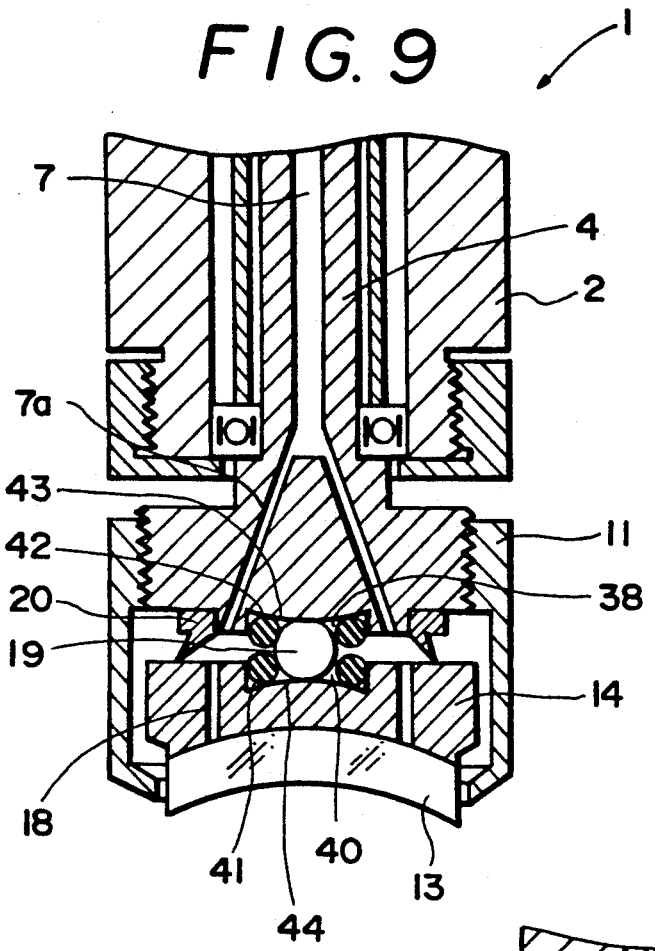

As shown in FIG. 9, if the bottom surface of the recess portion 38 of the holder body 4 is made a convex spherical surface 43 about the shaft center, the movement of the lens receptacle 14 may further be promoted and the displacement absorption of the lens 13 during the polishing may be increased and thus the machining surface accuracy may also be increased regardless of whether the lens to be polished has a convex or concave surface.

Eighth Embodiment

Figure 10:
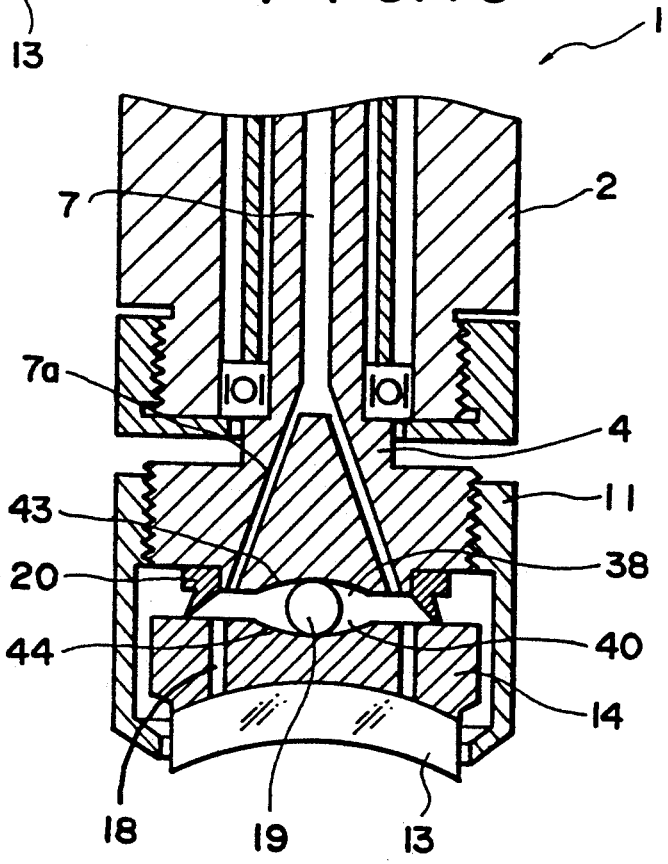
FIG. 10 is a longitudinal sectional view showing an eighth embodiment of a polishing work holder according to the present invention.

FIG. 10 is a sectional view showing eighth embodiment of polishing work holder according to the present invention.

In this embodiment, the recess portion 38 of the holder body 4 and the recess portion 40 of the lens receptacle 14 are made concave spherical surface 43, 44 having its center on the rotating axis of the holder body 4. The concave spherical surface 43 of the holder body 4 is made concentric to the surface to be machined of lens 13.

According to this embodiment, the tilting of lens is promoted by the point-contacting of the steel ball 19 with the concave spherical surface 43, 44 and the movement in radial direction is promoted by the rolling of the steel ball, so that the displacement of the lens 13 during the polishing may be absorbed with excellent followability, thereby performing lens polishing with high accuracy.

The concave spherical surface has a self-aligning effect as in the previous embodiment, so that the O rings may be omitted.

Ninth Embodiment

Figure 11:
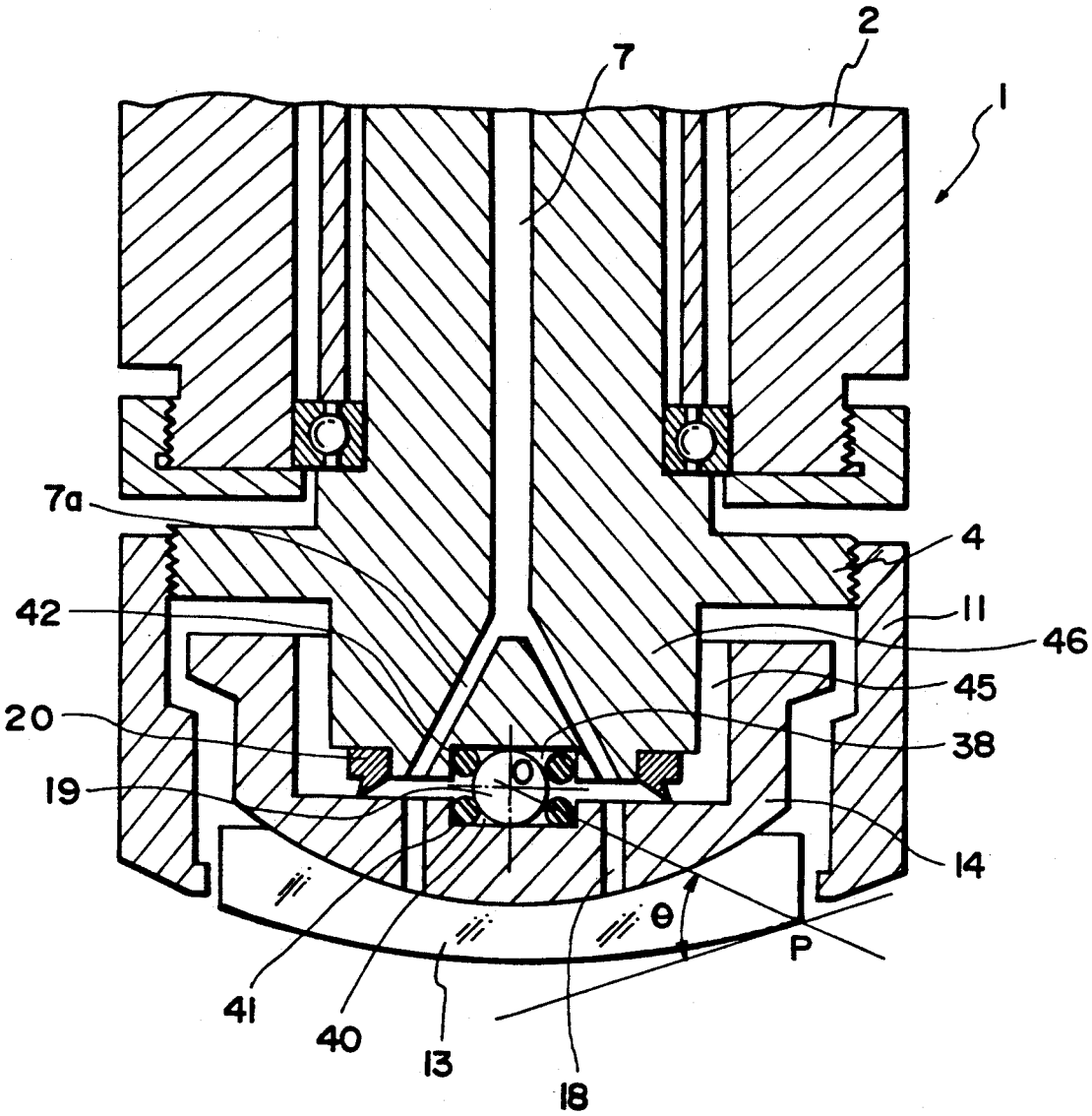
FIG. 11 is a longitudinal sectional view showing a ninth embodiment of a polishing work holder according to the present invention.

FIG. 11 is a sectional view showing a ninth embodiment of the polishing work holder according to the present invention. In this embodiment a, first recess portion 45 is formed at the upper surface of the lens receptacle 14 by the spot facing, and this first recess portion 45 has the bottom surface which is provided with a recess portion 38 for point-contacting it to a steel ball 19 as in the sixth embodiment. The holder body 4 has a small diameter portion 46 which is provided with a communicating hole 7 and a recess portion 38. In this construction, the position of the steel ball 19 is close to the surface to be polished of lens 13, so that an angle formed by a line OP connecting the center O of the steel ball 19 and a point P on the outer periphery of the surface being polished of lens 13, and a tangent on the point P of the surface, that is, a contact angle $\theta$ becomes small relative to the surface to be polished, and thus the holding performance of the lens provided by the lens receptacle against the polishing resistance caused during the polishing may be increased, thereby producing a lens with excellent machining surface accuracy and high quality and with stability.

Tenth Embodiment

Figure 12:
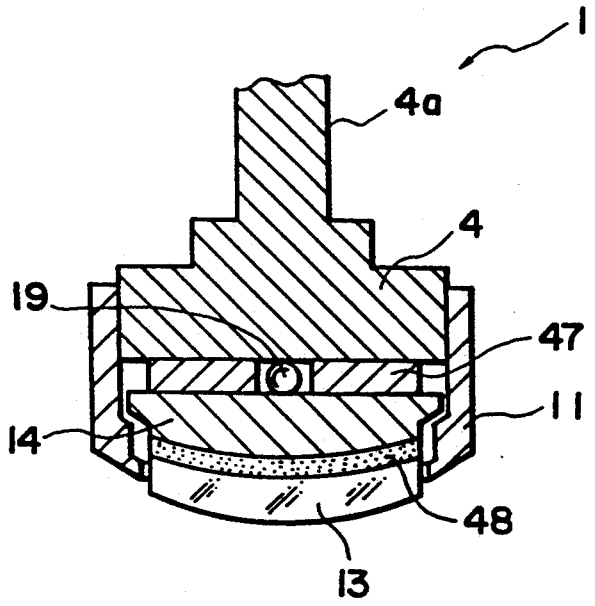
FIG. 12 is a longitudinal sectional view showing a tenth embodiment of a polishing work holder according to the present invention.

FIG. 12 is a sectional view showing a tenth embodiment of polishing work holder according to the present invention. In this embodiment, a lens 13 to be polished is supported through an elastic layer 48 adhered to the lens receptacle 14 the lens receptacle is rotatably suppressed on the holder body 4 by a shaft portion 4*a*. A spherical body 19 is inserted between the holder body 4 and the lens receptacle 14 and an elastic member 47 adhered to the holder body 4 encloses the spherical body 19 and is also inserted between the holder body 4 and the lens receptacle 14. A fixing ring 11 is concentrically secured to the outer periphery of the holder body 4.

According to this embodiment, the rolling of the spherical body 19 inserted between the holder body 4 and the lens receptacle 14 makes the movement of the lens receptacle 4 in the radial direction smooth, so that the shift from the shaft center of the lens 13 due to frictional resistance may be absorbed with good followability. The tilting of the lens receptacle 14 about the spherical body 19 absorbs the tilting of the lens 13 due to polishing resistance and the infinitesimal vibrating displacement with good followability.

The elasticity of an elastic member 47 inserted between the holder body 4 and the lens receptacle 14 prevents the abstract tilting of the lens receptacle 14 due to only the spherical body 19, resulting in a sure desired operation thereof.

Eleventh Embodiment

Figure 13:
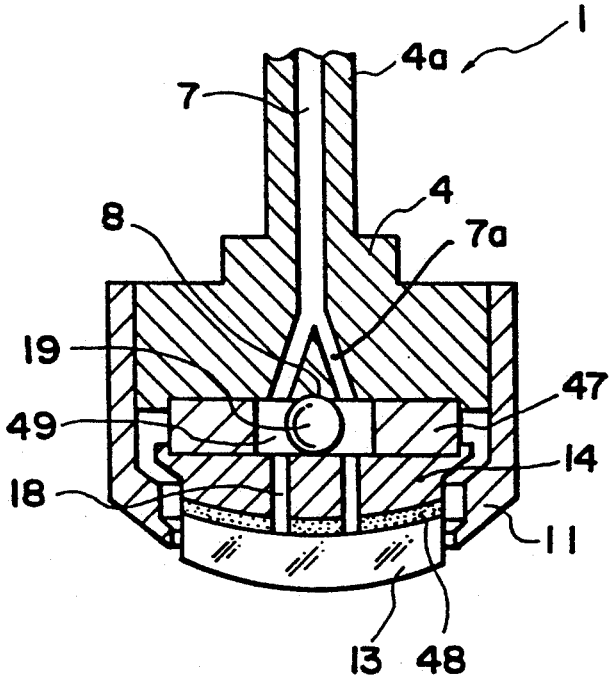
FIG. 13 is a longitudinal sectional view showing an eleventh embodiment of a polishing work holder according to the present invention.

FIG. 13 is sectional view showing an eleventh embodiment of the polishing work holder according to the present invention.

In this embodiment, the fundamental construction of the polishing work holder is the same as that of the holder shown in FIG. 12.

The lens receptacle 14 for supporting the lens 13 through the elastic layer 48 is provided at its center portion with a communicating hole and the shaft center portion of the holder body 4 is provided with a communicating hole 7 and then the center portion of an elastic member 47 inserted between the holder body 4 and the lens receptacle 14 is provided with a communicating hole 49.

The communicating hole 7 is connected to the suction pump (not shown) through the shaft portion 4*a* of the rotatable holder body 4, so that the lens 13 may be adhered to and supported to the lens receptacle 14 through respective communicating holes 7*a*, 49, 18 via a center suction effect.

The spherical body 19 may be a steel ball which is engaged in the recess portion 8 formed in the shaft center portion at the lower end surface of the holder body 4 and is engaged on the upper surface of the lens receptacle 14. The spherical body 19 is also placed in the center communicating hole 49 of the elastic member 47 and inserted between the holder body 4 and the lens receptacle 14.

The elastic member 47 is formed by a gel urethane.

The lens 13 supported by the above described work holder 1 is engaged with a polishing surface of the polishing dish (not shown) concentrically arranged relative to holder body 4 so that the whole work holder is also rotated by the rotation of the polishing dish, thereby performing the polishing o the lens 13.

During the polishing, the lens 13 is tilted by the machining resistance and the infinitesimal shift of the work holder shaft and the polishing dish shaft. This axial shift may be absorbed elastically by the elastic member 47 composed of gel urethane.

Even if the radial shift of the lens 13 arises during the polishing, the rolling effect o the steel ball 19 inserted between the holder body 4 and the lens receptacle 14 absorbs the radial movement of the lens receptacle 14 smoothly.

The absorption effect of radial shift of the lens 13 due to the rolling of the steel ball 19 may increase together with the elasticity of the elastic member 47 of the gel urethane so that the absorption effect ma surely be obtained by only the steel ball 19.

As a result of this, the chattering of the lens 13 may be effectively prevented during the polishing so that the lens may be obtained with an excellent machining surface accuracy and high quality while continuously uniformly contacting the lens 13 with the polishing dish.

The limitation of radial movement of lens receptacle during the polishing is determined by the fixing ring 11 screwed on the outer periphery of the holder body 4 together with the limitation of tilting angle of the lens receptacle 14. (In this case, the screw provided on the outer periphery of the holder body 4 and the screw provided in the upper and inner periphery of the fixing ring 11 are not shown).

The elastic member 47 is made of gel urethane, the O ring may be composed of gel silicon having a rubber hardness 30° or less thereby obtaining the same advantageous effect as that of previous embodiment.

Twelfth Embodiment

Figure 14:
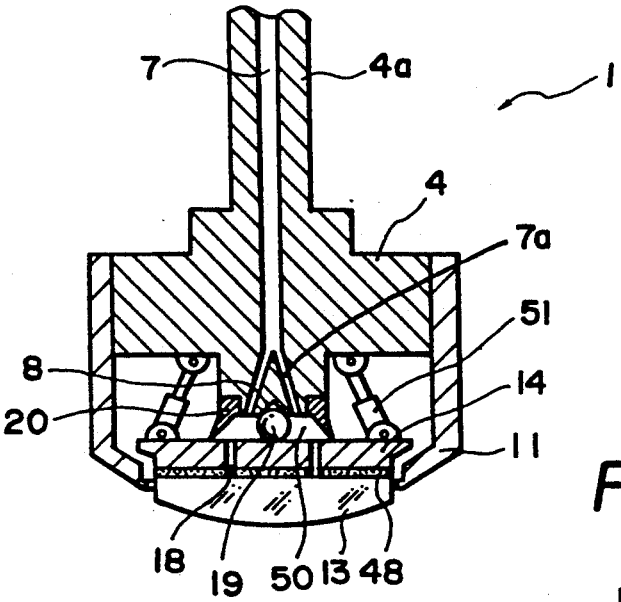
FIG. 14*a* is a longitudinal sectional view showing a twelfth embodiment of a polishing work holder according to the present invention.
FIG. 14*b* is a longitudinal sectional view showing a modification of the twelfth embodiment shown in FIG. 14*a*.
FIG. 14*c* is a cross sectional view showing a ring damper as an elastic member.
Figure 14:
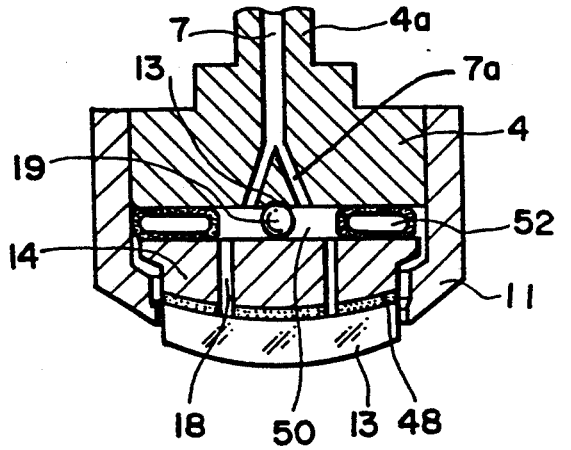
Figure 14:
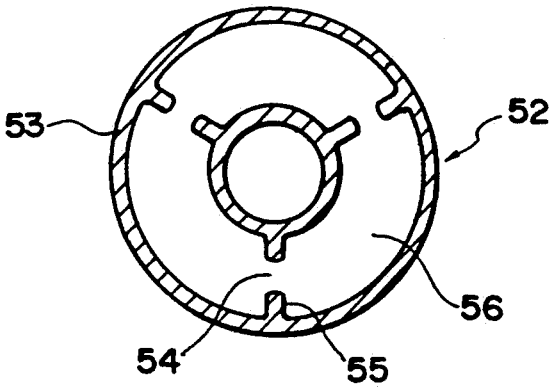

FIG. 14 shows a twelfth embodiment of the polishing work holder according to the present invention. FIG. 14*a* is a longitudinal section, FIG. 14*b* is a longitudinal section showing a modification in which the damper shown in FIG. 14*a* is replaced by a ring damper, and FIG. 14*c* is a cross sectional view showing the ring damper.

In this embodiment, a damper 51 is used as an elastic member of the polishing work holder shown in the eleventh embodiment.

Three dampers 51 are arranged between the holder body 4 and the lens receptacle and at equal intervals along the periphery direction to the shaft center of the holder body 4 and the lens receptacle 14. One end of respective dampers is rotatably secured to the holder body 4 and the other end thereof is rotatably secured to the lens receptacle 14. The securing direction of respective dampers 51 is made correspondent to the radial direction of the lens 13.

The outer periphery at the opening end of the communicating hole 7 of the holder body 4 is provided with a V ring 20 in order to hermetic-seal the opening end of the communicating hole 18 of the lens receptacle 14.

The rest of the construction of the work holder is the same as that of eleventh embodiment, so that like parts are designated by the same reference, and an explanation thereof is omitted.

According to the above construction, the lens 13 is adhered by vacuum through a sealing chamber 50 sealed by respective communicating holes 7, 7*a* and 18 as well as the V ring 20, thereby performing the polishing as in the eleventh embodiment.

Also, during the polishing, the elastic effect of each respective damper 51 instead of the elastic member 47 shown in the eleventh embodiment, and the sliding effect of the steel ball 19 and the synergistic effect of both effects make the lens 13 uniformly come in contact with the polishing dish (polishing wheel) so that the lens may be obtained with an excellent machining surface accuracy and high quality.

The ring damper 52 is placed between the holder body 4 and the lens receptacle 14 (see FIG. 14*b*) instead of the respective dampers 51, thereby providing means for the improved polishing of the lens 13.

The ring damper 52 is formed by providing at least three partitions 55 (three partition in the drawing) having communicating holes 54 at the hollow ring 53 as shown in FIG. 14*c* and by filling fluid 56 in the hollow ring 53.

Thirteenth Embodiment

Figure 15:
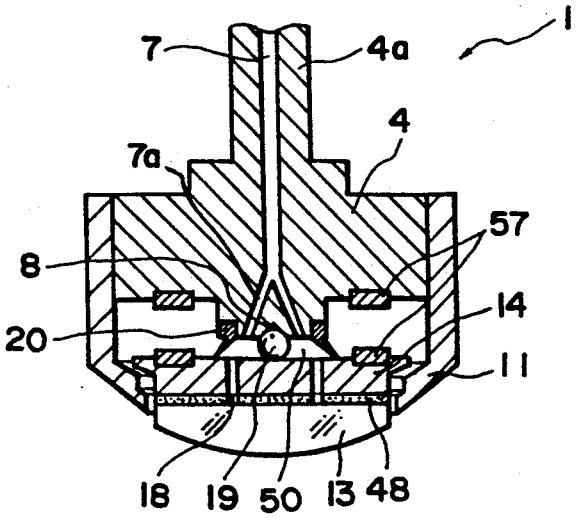
FIG. 15 is a longitudinal sectional view showing a thirteen embodiment of a polishing work holder according to the present invention.

FIG. 15 is a sectional view showing a thirteenth embodiment of the polishing work holder according to the present invention.

In this embodiment, the elastic member inserted between the holder body 4 and the lens receptacle is made by a permanent magnet 57 having ring shaped same polarity. This permanent magnet is arranged between the holder body 4 and the lens receptacle 14. The rest of the construction of the work holder is the same as that of the work holder shown in twelfth embodiment, so that like parts are shown by the same reference numerals and explanation thereof is omitted.

According to this embodiment, the lens 13 adhered to the lens receptacle 14 through respective communicating holes 7, 7*a*, 18 and the sealing chamber 50 and made in contact the rotating polishing dish, thereby holding the lens during the polishing. In this case, the tilting of the lens 13 during the elastic machining is absorbed by the repelling force of the permanent magnet together with the effect of the steel ball 19 thereby obtaining the advantageous polishing effects.

The ring shaped permanent magnet 57 is made of at least three segmental permanent magnets concentrically embedded between the holder body 4 and the lens receptacle 14.

Fourteenth Embodiment

Figure 16:
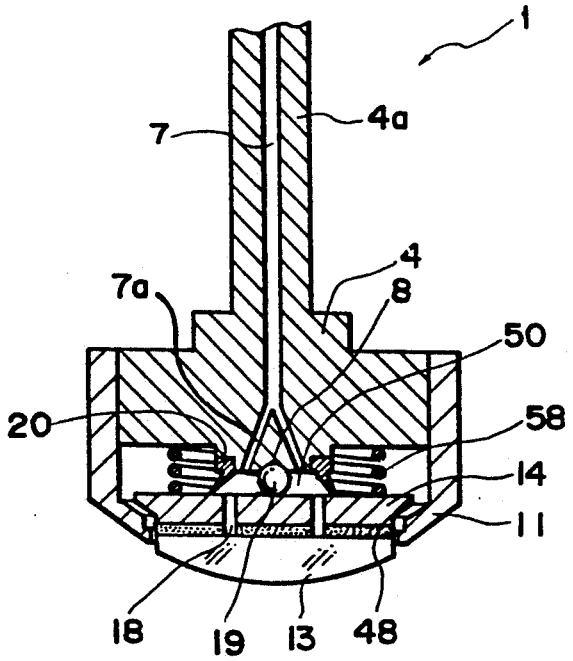
FIG. 16 is a longitudinal sectional view showing a fourteen embodiment of a polishing work holder according to the present invention.
Figure 17:
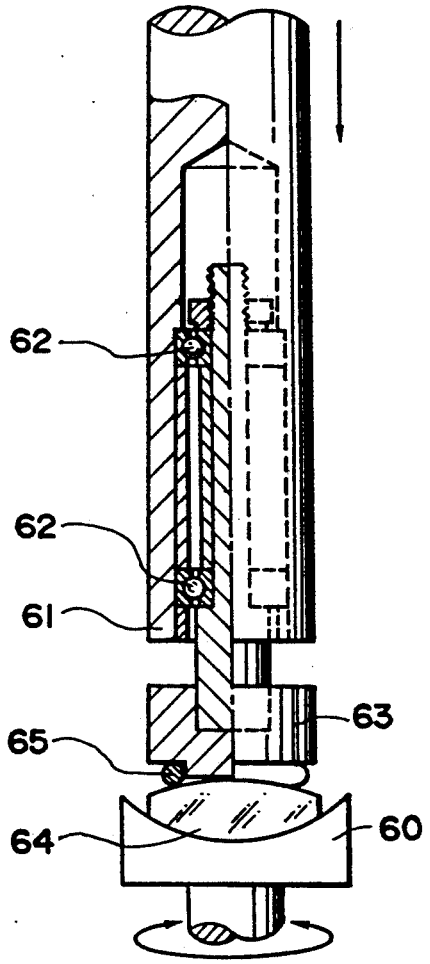
FIG.17 PRIOR ART
FIGS. 17 and 18 are side views partly in section showing a conventional polishing work holder.
Figure 18:
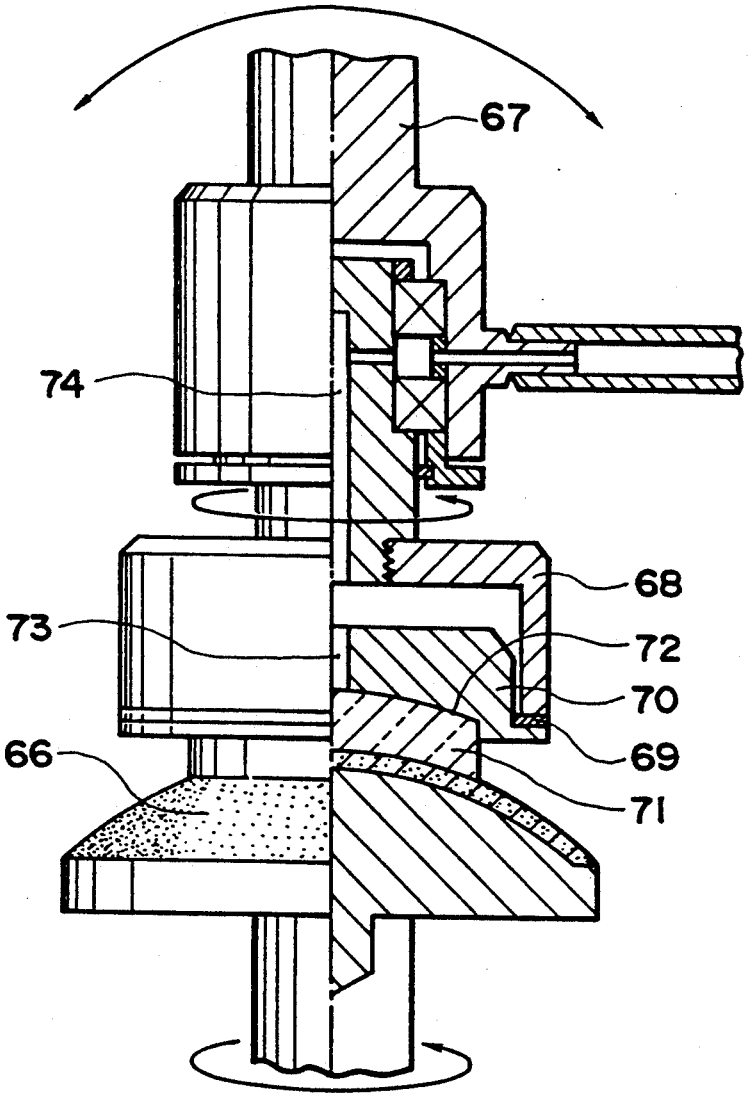
FIG. 18 PRIOR ART

FIG. 16 is a sectional view showing a fourteenth embodiment of the polishing work holder according to the present invention.

In this embodiment, a coil spring 58 is the elastic member and is disposed between the holder body 4 and the lens receptacle 14. The rest of the construction of the work holder is the same as that of the work holder shown in twelfth embodiment so that like parts are designated by the same reference numerals and explanation thereof is omitted.

According to this construction the polishing of lens 13 may be performed by the same method as that shown in previous embodiments and the tilting of the lens 13 during the machining is absorbed elastically by the coil spring 58 so that together with the rolling effect of the steel ball 19 the lens 13 may be obtained with an excellent machining surface accuracy and high quality together with the rolling effect of the steel ball 19.

The coil spring 58 is formed by arranging at least three coil springs (not shown) along the periphery direction between the holder body 4 and the lens receptacle 14 at equal intervals, thereby performing the polishing with the same advantageous effect.

What is claimed is:

1. A polishing work holder, comprising: a holder body rotatably supported by a housing and having a recess portion formed on a rotating shaft of one end face thereof and a suction hole opened at the end face; a lens receptacle having a hole communicated with the suction hole to hold a lens through suction at one end surface; a spherical body disposed between the recess portion of the holder body and the lens receptacle so as to contact the another end face and for tiltably and movably supporting the lens receptacle relative to the axis of the holder body; a fixing ring concentrically secured to the holder body and engageable with an outer periphery face of the lens or an outer periphery face of the lens receptacle so as to limit the tilting and the diametrical moving of the lens; and a sealing member provided between the holder body and the receptacle and outside of the suction hole; wherein the holder body, the spherical body and the lens receptacle are arranged in series so that respective end faces of the holder body, the spherical body and the lens receptacle are in contact with each other.

2. A polishing work holder according to claim 1; wherein the lens receptacle has a recess portion at is contacting face to the spherical body; and an elastic O ring inserted in the recess portion and in contact with the spherical body.

3. A polishing work holder according to claim 1; wherein the elastic O ring is inserted in at least one of the recess portion of the holder body and the recess portion of the lens receptacle, and the spherical body is disposed between both recesses.

4. A polishing work holder according to claim 1; wherein the recess portion of the holder body and the recess portion of the lens receptacle have a center positioned on a rotating axis of the holder body.

5. A polishing work holder, comprising: a holder body rotatably supported by a housing and having a suction hole opened at the end face; a lens receptacle having a hole communicated with the suction hole to hold a lens through suction at one end surface; a spherical body disposed between the recess portion of the holder body and the lens receptacle so as to contact the other end face and for tiltably and movably supporting the lens receptacle relative to the axis of the holder body; a fixing ring concentrically secured to the holder body and engageable with an outer periphery face of the lens or an outer periphery face of the lens receptacle so as to limit the tilting and the diametrical moving of the lens; and means for communicating the suction hole of the holder body with the hole of the lens receptacle; wherein the holder body, the spherical body and the lens receptacle are arranged in series so that respective end faces of the holder body, spherical body and lens receptacle are in contact with each other.

6. A polishing work holder, comprising; a lens receptacle having a suction hole for attracting and holding a lens, a holder body having a suction hole disposed at an end face for holding the lens receptacle, a spherical body disposed between a center portion of the lens receptacle and a center portion of the holder body, a fixing ring provided on the same axis as that of the holder body for limiting a tilt and radial movement of the lens, and an elastic member provided between the lens receptacle and the holder body, wherein the holder body, the spherical body and the lens receptacle are arranged in series so that respective end faces of the holder body, the spherical body and the lens receptacle are in contact with each other.

7. A polishing work holder, comprising: a holder body rotatably supported by a housing and having a recess portion formed on a rotating shaft of one end face thereof and a suction hole opened at the end face; a lens receptacle having a hole communicated with the suction hole to hold a lens through suction at one end surface; a spherical body disposed between the recess portion of the holder body and the lens receptacle so as to contact the another end face and for tiltably and movably supporting the lens receptacle relative to the axis of the holder body; a fixing ring concentrically secured to the holder body and engageable with an outer periphery face of the lens or an outer periphery face of the lens receptacle so as to limit the tilting and the diametrical moving of the lens; and an elastic member disposed between the holder body and the lens receptacle.

8. A polishing work holder for holding a lens, comprising: a holder body having an end surface; a lens receptacle having a backside, at least one communicating through-hole and a lens receiving portion; supporting means for tiltably and movably supporting the lens receptacle relative to the holder body; limiting means for limiting the tilt and movement of the lens receptacle; and suction applying means for applying suction through each communicating through-hole to hold a lens to be polished against the lens receiving portion.

9. A polishing work holder according to claim 8; wherein the supporting means comprises a supporting member disposed between the end surface of the holder body and the backside of the lens receptacle.

10. A polishing work holder according to claim 9; wherein the supporting means further comprises a recess portion formed in at least one of the end surface and the backside, and the supporting member is disposed in each recess portion.

11. A polishing work holder according to claim 10; wherein the supporting member is a spherical member.

12. A polishing work holder according to claim 10; wherein the supporting means further comprises an elastic O ring disposed between the supporting member and either of the end surface and the backside.

13. A polishing work holder according to claim 10; wherein the supporting means further comprises a first elastic O ring disposed between the supporting member and the end surface, and a second elastic O ring disposed between the supporting member and the back side.

14. A polishing work holder according to claim 8; wherein the limiting means comprises a fixing ring concentrically secured to the holder body and engageable with an outer periphery face of the lens or an outer periphery face of the lens receptacle so as to limit the tilting moving of the lens.

15. A polishing work holder according to claim 8; wherein the suction applying means includes a through-hole disposed in the holder body.

16. A polishing work holder according to claim 8; further comprising means mounting the lens receptacle to be supported by the limiting means when the suction applying means is not applying suction and tiltable and movable when the suction applying means is applying suction.

* * * * *